United States Patent [19]

Aiken, Jr. et al.

[11] Patent Number: 4,694,126

[45] Date of Patent: Sep. 15, 1987

[54] MEMBRANE KEYBOARD SWITCH ASSEMBLY HAVING SPACER STRUCTURE AND METHOD OF MAKING

[75] Inventors: Hugh H. Aiken, Jr., Milford; Gordon B. Langford, Amherst, both of N.H.

[73] Assignee: AMP Incorporated, Harrisburg, Pa.

[21] Appl. No.: 868,822

[22] Filed: May 29, 1986

[51] Int. Cl.[4] ..... H01H 13/70

[52] U.S. Cl. ..... 200/5 A; 29/622; 200/159 B; 200/86 R

[58] Field of Search ..... 200/5 A, 86 R, 159 B; 29/622

[56] References Cited

U.S. PATENT DOCUMENTS

| | | | |
|---|---|---|---|
| 3,668,337 | 6/1972 | Sinclair | 200/5 A |
| 4,220,815 | 9/1980 | Gibson, Jr. et al. | 200/86 R X |
| 4,317,013 | 2/1982 | Larson | 200/5 A |
| 4,324,962 | 4/1982 | Dulen | 200/5 A X |
| 4,382,165 | 5/1983 | Balash et al. | 200/5 A |
| 4,391,845 | 7/1983 | Denley | 200/5 A X |
| 4,451,714 | 5/1984 | Eventuff | 200/5 A |
| 4,463,232 | 7/1984 | Takakuwa | 200/86 R |
| 4,525,606 | 6/1985 | Sado | 200/5 A |

*Primary Examiner*—J. R. Scott

*Attorney, Agent, or Firm*—Katherine A. Nelson

[57] ABSTRACT

A membrane keyboard is comprised of first and second dielectric layers having circuit patterns including a plurality of first and second electrical contact pads disposed on opposing surfaces thereof. The layers are maintained together such that corresponding first and second electrical contact pads overlie one another forming switch sites. A spacer is disposed in a discontinuous pattern around the first contact pads, the spacer normally maintaining corresponding first and second contact pads spaced from each other, while permitting electrical engagement therebetween upon application of an actuation force to one of the layers at a switch site.

20 Claims, 8 Drawing Figures

10
12
14
16
18
20
22
23
24
25
26
27
28
30
2

MEMBRANE KEYBOARD SWITCH ASSEMBLY HAVING SPACER STRUCTURE AND METHOD OF MAKING

FIELD OF THE INVENTION

This invention relates to a field of electrical keyboards and particularly to membrane keyboards having opposed or facing circuit layers which are separated from each other and have contact areas or elements which may be selectively brought into contact to complete an electrical circuit.

BACKGROUND OF THE INVENTION

Membrane keyboards of the general type with which this present invention is concerned are well known in the art. Conventionally these keyboards have a pair of circuit layers, one fixed and one movable, separated by a spacer or separator layer. Typically the circuit layers are sheets of insulative material such as Mylar, with circuit patterns disposed thereon. The circuit patterns face each other and are separated by a spacer such as Mylar which has apertures at the location of the aligned contact elements on the fixed and movable circuit sheets. Electrical interconnection is effected by applying pressure to specific locations on one of the circuit sheets to move a contact area on that circuit sheet through an aperture to make contact with a corresponding contact element on the other circuit sheet. The fixed and movable circuit layers and spacer may be separate sheets of material, or an arrangement of a single sheet of material folded over in any desired fashion. Generally keyboards of this configuration are formed in a laminate construction the layers being bonded together, sealed or otherwise fixed against relative lateral movement between the layers. In addition, the assembly may include an overlay sheet with indicia of one kind or another to identify the key locations and a backup plate to support the assembly.

Spacer layers may also be formed by applying a printed or silkscreened apertured pattern of a dielectric material to one or both of the circuit layers. U.S. Pat. No. 4,382,165 discloses a membrane switch having a layer of non-conductive adhesive applied to at least one of the circuit layers and a discontinuous pattern of dielectric material on the contact elements. Generally the layer is from 0.001 to 0.002 inches thick, which is thinner than conventional spacer sheets which typically are 0.003 to 0.005 inches thick. The discontinuous pattern of insulating material on the contact elements themselves are necessary with the thinner printed spacer layer to prevent unintended short circuiting of contacts. This is particularly a problem when the contact pad or key area is relatively large such as those designed to be actuated by fingers.

The amount of force necessary to operate individual keys in membrane-type keyboards are affected by both the thickness of the spacer means and by the size of the apertures. Use of a conventional apertured spacer sheet with small contact pad or key areas having a 0.300 inch diameter or less, are generally unacceptable because of the high actuation force needed to operate the switch contact. Use of an apertured printed dielectric material is also unacceptable for small key areas because the movable circuit layer is unevenly separated from the other circuit layer owing to the thickness of the conductor leading to the contact pad or key area in combination with the thickness of the non-conductive material overlying that conductor. Because the thickness of the spacer layer at any one contact or key area varies in accordance with the number and location of conductors leading into that area, the actuation force will be different at different key locations. While the unevenness in the thickness of the spacer layer is relatively negligible in larger key areas, it produces a great effect on key pads having a small diameter. Use of dielectric material on the contact areas themselves as taught in U.S. Pat. No. 4,382,165 is generally unnecessary for small contact areas and, if used, would serve to increase the amount of actuation force required to effect interconnection.

With the foregoing in mind, it is an object of the present invention to provide a membrane keyboard having very small contact areas for the keys.

It is an additional object of the invention to provide a method for making the above described keyboard.

It is a further object of the invention to provide a membrane keyboard having a controlled actuation force for the keys.

It is a further object of the invention to provide a keyboard for mechanically operated switches.

In addition, it is an object to provide a membrane circuit for use under a full-travel keyboard for computers, typewriters and the like, which requires no more than two layers of film.

SUMMARY OF THE INVENTION

In accordance with the present invention, the conventional separate apertured spacer layer and the printed apertured dielectric layer are replaced by discontinuous spacer means disposed on the surface of at least one of the dielectric layers in a symmetrical discontinuous pattern around the contact pad and not on that portion of the conductor which enters the contact pads or the contact pads themselves. Thus the thickness of the spacer means alone determines the distance between the movable and lower circuit layers and the actuation force required to effect contact between the two layers.

The keyboard is comprised of a first dielectric layer having a first electrical contact means disposed thereon, a second dielectric layer having second electrical contact means disposed thereon, means for maintaining the two dielectric layers together so that the first and second contact means overlie one another to form switch sites and spacer means as part of at least one of the dielectric layers disposed in a discontinued pattern around at least the first contact means. The spacer means normally maintains the first and second contact means spaced from each other, but permits electrical engagement therebetween upon application of an actuation force to either the first or second dielectric layer at the switch site.

Some of the features and advantages of the invention having been briefly stated, others will appear from the detailed description which follows when taken in connection with the accompanying drawings.

DETAILED DESCRIPTION OF THE DRAWINGS

Figures 1, 2, 2A:
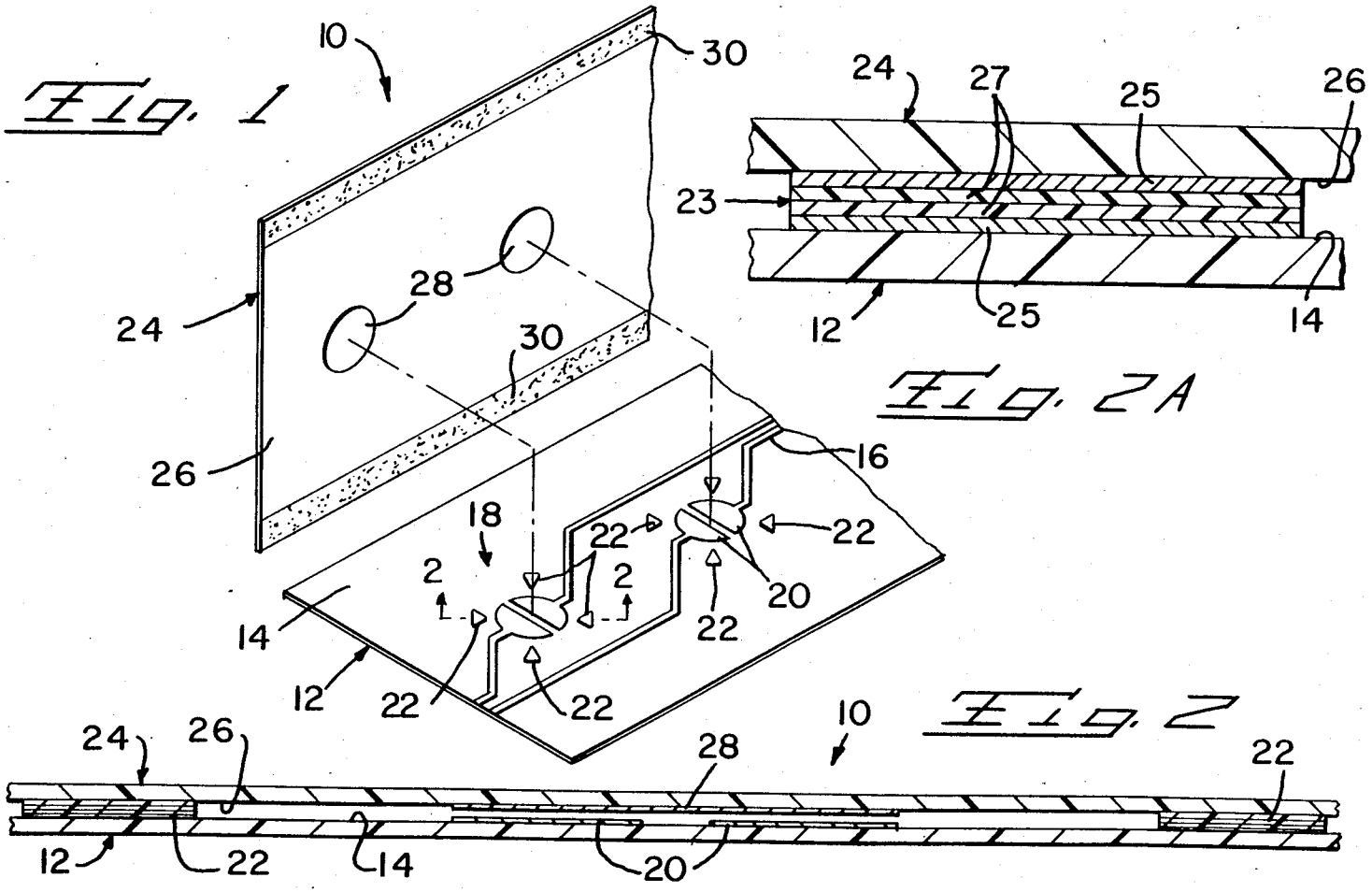
FIG. 1 is a fragmentary exploded perspective view of a membrane keyboard in accordance with the invention.
FIG. 2 is an enlarged cross-sectional view taken along line 2—2 of an assembled keyboard of FIG. 1.
FIG. 2A is an enlarged fragmentary cross-sectional view of an alternative embodiment of the spacer means in accordance with the invention.
Figure 3:
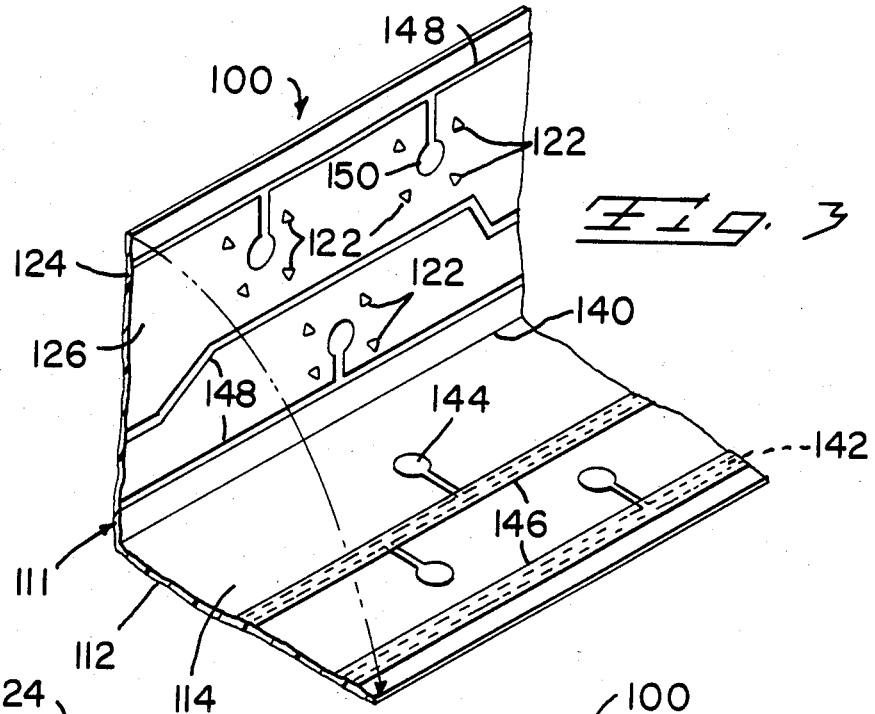
FIG. 3 is a fragmentary exploded perspective view of further embodiment of a membrane keyboard in accordance with the present invention.

FIGS. 1 and 2 illustrate first embodiment 10 of a membrane keyboard comprised of first and second dielectric layers 12 and 24. First dielectric layer 12 has electrical conductor paths 16 disposed on inner surface 14 thereof. The conductor paths 16 have bifurcated electrical contact pads 18 comprised of portions 20 separated by space 21. Surface 14 further has spacer means 22 disposed symmetrically in a discontinuous pattern about the contact pads 18, the spacer means 22 being disposed directly on dielectric layer 14 and not on the conductor paths 16 or contact pads 18.

As is shown in FIG. 2, spacer means 22 is comprised of several layers of dielectric material which have been printed directly on the surface 14. FIG. 2A shows an alternative embodiment 23 of spacer means wherein the top and bottom layers 25 of the spacer means are comprised of an electrically isolated deposit of conductive material preferably having the same composition as and disposed concurrently with the circuit paths and contact pads. In the preferred embodiment of the invention, the conductive material comprises silver ink which is screen printed onto surfaces 14 and 26. Successive layers of dielectric material 27 are then screen printed onto first layers 25 to form spacer means 23. Use of the same material for the circuit paths 16, contact pads 18, 28 and layers 25 of spacer means essentially eliminates the thickness of the contact pads 18, 28 as variables in controlling the distance between the surface of contact pad 18 and the surface of contact pad 28.

Dielectric layer 24 has a plurality of electrical contact pads 28 disposed on inner surface 26 thereof, said contact pads 28 being disposed on that surface such that each contact pad 28 is aligned with a corresponding contact pad 18 when the two dielectric layers are maintained in an overlying relationship to form a membrane keyboard. Surface 26 further has a plurality of adhesive strips 30 which are used to adhere said first and second substrate layers 12, 24 to each other to prevent lateral movement between the substrate layer in the membrane keyboard. Alternatively, mechanical means such as pins, stakes and the like may be used for lateral registration instead of an adhesive. Spacer means 22, as is shown in FIG. 2, is spaced apart from the corresponding contact pads 18 and 28 to maintain a uniform spacing between corresponding pads, thus providing for more precise control of the amount of actuation force required to effect electrical interconnection at the switch site.

Figure 4:
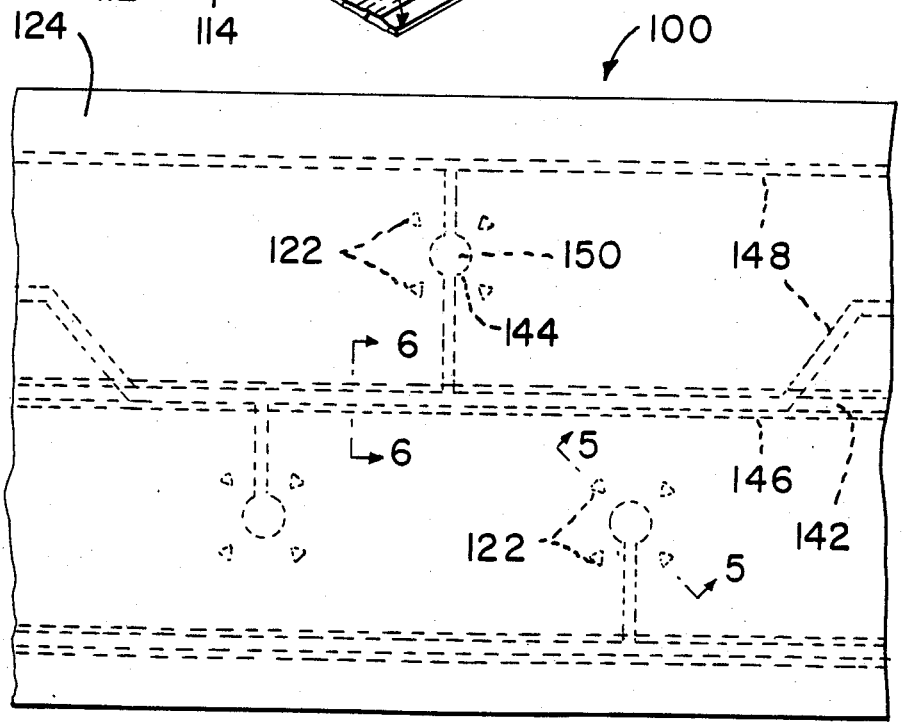
FIG. 4 is a top plan view of the assembled keyboard of FIG. 3.

FIGS. 3, 4, 5 and 6 illustrate an alternative embodiment 100 comprised of a single dielectric substrate 111 which is folded at 140 to form first and second portions 112, 124, respectively. Surface 114, of portion 112, has a plurality of circuit paths 142 disposed thereon, the circuit paths 142 having a plurality of contact pads 144 associated therewith, electrically connected thereto but spaced apart from said circuit paths 142. Surface 126 of portion 124 has a plurality of circuit paths 148 disposed thereon, said circuit paths 148 having a plurality of corresponding contact pads 150 associated therewith, electrically connected thereto but spaced apart therefrom. Surface 126 further has spacer means 122 disposed symmetrically in a discontinuous pattern about contact pads 150. This spacer means may be comprised of one or more successive layers of dielectric material or a layer of conductive material followed by dielectric material as previously described. Surface 114 further has an electrically insulating layer 146 disposed over circuit paths 142 to provide insulation between conductor paths 142, 148 on surfaces 114, 126 when they are brought together to form the keyboard as is shown in FIG. 4. FIG. 4 also clearly illustrates that the contact pads 144, 150 are spaced apart from circuit paths 142, 148 and dielectric insulating material 146. The thickness of the layer of insulating material 146 overlying the circuit paths 142 does not, therefore, interfere with the uniform spacing between contact pads 144, 150, and affect the amount of actuation force required to effect interconnection.

Figure 5:
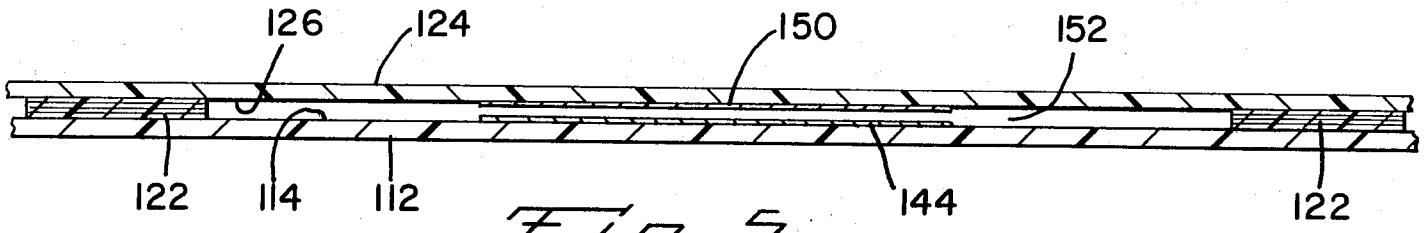
FIG. 5 is an enlarged cross-sectional view taken along line 5—5 of an assembled keyboard of FIG. 4.
Figure 7:
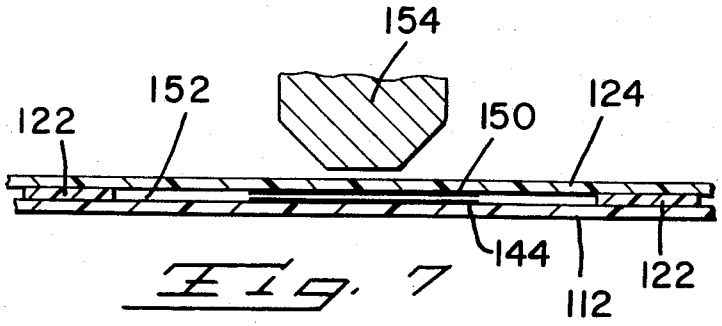
FIG. 7 is a fragmentary cross-sectional view illustrating a contact area and its corresponding actuator.
Figure 6:
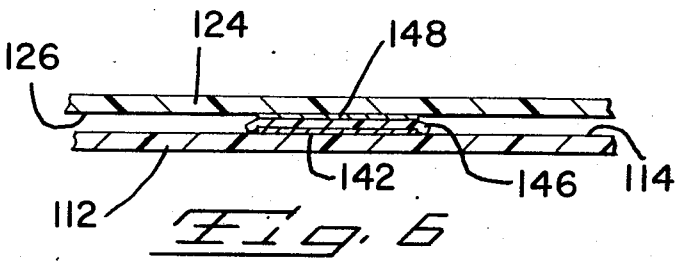
FIG. 6 is an enlarged cross-sectional view taken along line 6—6 of an assembled keyboard of FIG. 4.

FIGS. 5 and 6 show cross sectional views of the assembled switch. FIG. 5 is taken through a switch portion illustrating spacer means 122 which is spaced apart at 152 from the corresponding contact pads 144 and 150. In accordance with the invention, spacer means 122 provide evenly spaced contact pads at the switch site. FIG. 6 illustrates the dielectric insulating layer 146 disposed over circuit paths 142 on surface 114. In accordance with the present invention the insulating layers 146 over any circuit paths 142 are spaced sufficiently apart from the contact pads so that the thickness of the conductor path 142 and the thickness of the insulating layer 146 will not distort the spacing between the contact pads 144 and 150. FIG. 7 illustrates a mechanical actuator 154 in registration with the contact pads 144, 150 in accordance with the invention. When force is applied to actuator 154, it moves downward to bring contact pad 150 into electrical engagement with pad 144.

In making the membrane switch in accordance with this invention the desired circuit patterns are disposed on surfaces 14, 26 of substrates 12 and 24. The dielectric substrates are typically polyester, such as Mylar, and the circuit patterns may be comprised of conductive ink, etched copper or the like, and applied by means known in the art. It is to be understood that the circuit conductors and the contact pads may be of any desired configuration providing that the contact pads are sufficiently spaced apart from the circuit paths so that dielectric material disposed over the circuit paths will be absent from the area immediately surrounding the contact pads. The configurations shown in the accompanying drawings are for purposes of illustration only.

In the preferred embodiment the circuit patterns are screened silver conductive ink from about 0.0005 to 0.0007 inches thick and 0.02 inches wide and the contact pads having diameter of 0.050 inches on a 0.4 inches center line. A screen printable dielectric coating about 0.002 inches thick is then disposed over the desired circuit paths to provide insulation. A number of materials are available on the market that may be used for this coating, one such being ML25089 UV curable dielectric coating available from Acheson Colloids Company, Port Huron, Mich. This same dielectric coating mixture can be used to dispose the spacing means around each switch site. Multiple layers of the coating may be applied until the desired thickness is obtained for the spacer means. It is to be understood that the dielectric coating may also be used to provide insulation between two or more circuit layers on one or both substrates to provide a multilayer keyboad. Depending upon the pattern of the circuitry, the spacer means may be disposed on the surfaces of one or both substrate layers. Spacer means may also be integrally formed by forming a series of upstanding protrusions around each contact pad, in essentially the same way as dimples or domes are formed as known in the art. If adhesive is to be used for registration purposes, a layer of about 0.001 inches thick is applied to the desired areas after the dielectric material has been cured. No adhesive is necessary when mechanical registration means are used.

The keyboard of the present invention is particularly useful for keys having diameters of 0.3 inches or less and which are mechanically actuated. By locating the spacer means on the dielectric substrate and away from the contact pad area, the distance between corresponding contact pads on the two dielectric layers can be carefully controlled thus providing a uniform distance between overlying contact pads and a narrow tolerance range for the amount of actuation force required for electrically engaging a switch.

In the drawings and specification, there have been set forth preferred embodiments of the invention, and although specific terms are employed, they are used in a generic and descriptive sense only, and not for purposes of limitation.

What is claimed is:

1. A membrane switch comprising:

a first dielectric layer having a plurality of first elongated electrical conductors disposed thereon, each of said first conductors being in electrical communication with but spaced from first contact pad means;

a second dielectric layer having a plurality of second elongated electrical conductors disposed thereon, each of said second conductors being in electrical communication with but spaced from second contact pad means, said first and second contact pads forming switch sites when placed in facing relationship;

spacer means as part of said first dielectric layer, said spacer means being disposed in a symmetrical discontinuous pattern around but remote from said first contact pad means, said spacer means normally maintaining said first and second contact pad means spaced from each other at said switch sites and permitting electrical engagement there between upon application of an actuation force to said switch sites;

electrical insulating means disposed between at least one of any opposed first and second conductors when said first and second dielectric layers are assembled to form said membrane switch, said insulating means being spaced from said switch site; and means for holding said first and second dielectric layers in alignment so that corresponding first and second contact pad means overlie one another at said switch sites.

2. The electrical switch as described in claim 1 wherein said spacer means comprises a dielectric material disposed on said first dielectric layer.

3. The electrical switch as described in claim 1 wherein said spacer means is integrally formed in said first dielectric layer.

4. The electrical contact switch as described in claim 1 wherein said spacer means is comprised of at least one layer of conductive material electrically isolated from said first elongated conductors and said first contact pad means and at least one layer of dielectric material disposed on said at least one layer of electrically isolated conductive material.

5. The membrane switch as described in claim 1 further comprising another spacer means as part of said second dielectric layer, said another spacer means being disposed in a symmetrical discontinuous pattern around but remote from said second contact pad means, said pattern of said another spacer means being coincident with said pattern of said spacer means on said first dielectric layer.

6. The membrane switch as described in claim 5 wherein said another spacer means comprises a dielectric material disposed on said second dielectric layer.

7. The membrane switch as described in claim 5 wherein said another spacer means comprises at least one layer of conductive material electrically isolated from said second elongated conductors and said second contact pad means and at least one layer of dielectric material disposed on said at least one layer of electrically isolated conductive material.

8. A membrane keyboard having a plurality of spaced apart switch sites, comprising:

a first dielectric layer having a plurality of elongated first conductors disposed thereon, each of said first conductors being in electrical communication with but spaced from at least one first contact pad means;

a second dielectric layer having a plurality of elongated second conductors disposed thereon, each of said second conductors being in electrical communication with but spaced from at least one second contact pad means, said first and second contact pad means forming spaced apart switch sites when placed in facing relationship;

spacer means as part of said first dielectric layer, said spacer means being disposed in a symmetrical discontinuous pattern around but remote from said first contact pad means, said spacer means normally maintaining said first and second contact pad means spaced from each other at said spaced apart switch sites but permitting electrical engagement there between upon application of an actuation force to said switch site;

electrical insulating means disposed between and overlying first and second conductors when said first and second dielectric layers are assembled to form said membrane keyboard, said insulating means being spaced from said switch sites; and means for holding said first and second dielectric layers in alignment so that corresponding first and second contact pad means overlie one another at said spaced apart switch sites.

9. The membrane keyboard as described in claim 8 wherein said spacer means comprises a dielectric material disposed on said first dielectric layer.

10. The membrane keyboard as described in claim 8 wherein said spacer means is comprised of at least one layer of conductive material electrically isolated from said first elongated conductors and said first contact pad means and at least one layer of dielectric material disposed on said at least one layer of electrically isolated conductive material.

11. The membrane keyboard as described in claim 8 further comprising another spacer means as part of said second dielectric layer, said another spacer means being disposed in a symmetrical discontinuous pattern around but remote from said second contact pad means, said pattern of said another spacer means being coincident with said pattern of said spacer means on said first dielectric layer.

12. The membrane keyboard as described in claim 11 wherein said another spacer means comprises a dielectric material disposed on said second dielectric layer.

13. The membrane keyboard as described in claim 11 wherein said other spacer means comprises at least one layer of conductive material electrically isolated from said second elongated conductors and said second contact pad means and at least one layer of dielectric material disposed on said at least one layer of electrically isolated conductive material.

14. The membrane keyboard as described in claim 11 wherein said switch sites are closely spaced apart and are dimensioned to be mechanically actuated.

15. A method for making a membrane switch comprising the steps of:

disposing a plurality of first elongated electrical conductors on a first dielectric layer each of said first conductors being in electrical communication with but spaced from first contact pad means;

disposing a plurality of second elongated electrical conductors on a second dielectric layer, each of said second conductors being in electrical communication with but spaced from second contact pad means, said first and second contact pads forming switch sites when placed in a facing relationship;

disposing spacer means as part of said first dielectric layer, said spacer means being disposed in a symmetrical discontinuous pattern around but remote from said first contact pad means, said spacer means normally maintaining said first and second contact pad means spaced from each other at said switch sites and permitting electrical engagement there between upon application of an actuation force to said switch sites;

disposing electrical insulating means between at least one of any opposed first and second conductors when said first and second dielectric layers are assembled to form said membrane switch, said insulating means being spaced from said switch sites; and providing means for holding said first and second dielectric layers in alignment so that corresponding first and second contact pad means overlie one another at said switch sites.

16. The method for making the membrane keyboard as described in claim 15 wherein said spacer means comprises a dielectric material disposed on said first dielectric layer.

17. The method of making the membrane keyboad as described in claim 15 wherein said spacer means is comprised of at least one layer of conductive material electrically isolated from said first elongated conductors and said first contact pad means and at least one layer of dielectric material disposed on said at least one layer of electrically isolated conductive material.

18. The method of making the membrane switch as described in claim 15 further comprising another spacer means as part of said second dielectric layer, said another spacer means being disposed in a symmetrical discontinuous pattern around but remote from said second contact pad means, said pattern of said another spacer means being coincident with said pattern of said spacer means on said first dielectric layer.

19. The method of making the membrane switch as described in claim 18 wherein said another spacer means comprises a dielectric material disposed on said second dielectric layer.

20. The method of making the membrane switch as described in claim 18 wherein another spacer means comprises at least one layer of conductive material said pattern of said another spacer means being coincident with said pattern of said spacer means on said first dielectric layer.

* * * * *